US009139337B2

(12) United States Patent
Song

(10) Patent No.: US 9,139,337 B2
(45) Date of Patent: Sep. 22, 2015

(54) ROUND TRIP ENVELOPE

(75) Inventor: Koon Chul Song, Osaka (JP)

(73) Assignee: SONG CO., LTD., Osaka (JP)

( * ) Notice: Subject to any disclaimer, the term of this patent is extended or adjusted under 35 U.S.C. 154(b) by 0 days.

(21) Appl. No.: 14/364,783

(22) PCT Filed: Jan. 30, 2012

(86) PCT No.: PCT/JP2012/051941

§ 371 (c)(1),
(2), (4) Date: Jun. 12, 2014

(87) PCT Pub. No.: WO2013/088748

PCT Pub. Date: Jun. 20, 2013

(65) Prior Publication Data

US 2014/0332586 A1 Nov. 13, 2014

(30) Foreign Application Priority Data

Dec. 14, 2011 (JP) ..... 2011-272976

(51) Int. Cl.
*B65D 27/06* (2006.01)

(52) U.S. Cl.
CPC ..... *B65D 27/06* (2013.01)

(58) Field of Classification Search
CPC ..... B65D 27/06
USPC ..... 229/300–306
See application file for complete search history.

(56) References Cited

U.S. PATENT DOCUMENTS

| | | | | | |
|---|---|---|---|---|---|
| 4,669,652 | A * | 6/1987 | Seguin | 229/303 |
| 4,917,287 | A * | 4/1990 | Watson | 229/306 |
| 5,400,957 | A * | 3/1995 | Stude | 229/303 |
| 5,516,040 | A * | 5/1996 | Lin | 229/302 |
| 5,738,274 | A * | 4/1998 | Stude | 229/301 |
| 2010/0219233 | A1 * | 9/2010 | Rosen et al. | 229/301 |

FOREIGN PATENT DOCUMENTS

| | | |
|---|---|---|
| JP | 55101738 | 7/1980 |
| JP | 6429139 | 2/1989 |
| JP | 2005091529 A | 4/2005 |
| JP | 2007045521 A | 2/2007 |

* cited by examiner

*Primary Examiner* — Jes F Pascua
(74) *Attorney, Agent, or Firm* — Bacon & Thomas, PLLC

(57) ABSTRACT

A round trip envelope with front and back faces for writing the outgoing and return addresses, and which enables sealing for both of outgoing mail and return mail sealing flap, which can prevent erroneous postmarking of a stamp. An outgoing stamp affixing area and address writing area are on the front face of the envelope body, and a return stamp affixing area and a return address writing area on the back face. An adhesive area for sealing a sealing flap in a blank area on the back face, in a vicinity of an opening. A distal end portion of the sealing flap extending beyond the adhesive area constitutes a return-mail sealing flap.

15 Claims, 7 Drawing Sheets

ROUND TRIP ENVELOPE

TECHNICAL FIELD

The present invention relates to a round trip envelope which can be used for both outgoing mail and return mail.

BACKGROUND ART

Conventionally, while double postcards are used commonly, round trip envelopes are not so common.

Japanese Patent Application Laid-Open No. 10-119975 (Patent Document 1) discloses a round trip envelope which is provided with two sealing flaps of a sealing flap (4) for outgoing mail and a sealing flap (3) for return mail.

Domestic Re-publication of PCT International Publication No. 2003/055759 (Patent Document 2) discloses a round trip envelope which uses a same face of the envelope for displaying the outgoing address and the return address. Sealing of a tongue (5) is broken when opening the envelope. The outgoing address is written on the tongue (5), while the return address is written in that portion on the envelope which is hidden by the tongue (5).

Japanese Patent Application Laid-Open No. 2010-132313 (Patent Document 3) also discloses a round trip envelope which uses a same face of the envelope for displaying the outgoing address and the return address. The return address is written on the back of a flap (22, 23).

Japanese Patent Application Laid-Open No. 1111-49178 (Patent Document 4) discloses a method for making a round trip envelope and a method for sealing. A sheet for writing the outgoing address thereon is removably adhered to a front face of the envelope. After the envelope is opened, the sheet is removed, so that the envelope is used for return mail.

Japanese Utility Model Registration No. 3123468 (Patent Document 5) discloses a round trip envelope which has transparent surfaces and sealing paper with two strips of an adhesive strip 4 for outgoing mail and an adhesive strip 6 for return mail. The envelope uses a same face of the envelope for displaying the outgoing address and the return address.

Japanese Utility Model Registration No. 3044397 (Patent Document 6) discloses a round trip envelope which has a front face on which the outgoing address is written and a back face on which the return address is written.

PRIOR ART DOCUMENTS

Patent Documents

Patent Document 1: Japanese Patent Application Laid-Open No. 10-119975

Patent Document 2: Domestic Re-publication of PCT International Publication No. 2003/055759

Patent Document 3: Japanese Patent Application Laid-Open No. 2010-132313

Patent Document 4: Japanese Patent Application Laid-Open No. H11-49178

Patent Document 5: Japanese Utility Model Registration No. 3123468

Patent Document 6: Japanese Utility Model Registration No. 3044397

DISCLOSURE OF THE INVENTION

Problems to be Solved by the Invention

Patent Document 1 above has a problem that it is not easy to fabricate the round trip envelope, because it requires two sealing flaps (3, 4).

Patent Document 2 above has the following problems. As the outgoing address needs to be written on the tongue (5) of the envelope, the writing space is insufficient, or otherwise, the tongue (5) needs to be increased in size considerably. Further, since the same face of the envelope is used for outgoing mail and return mail, when writing the name and address of the sender, it may be difficult to distinguish between the sender of the outgoing mail and the sender of the return mail. It is also necessary to carefully provide the display spaces for the sender of the outgoing mail and the sender of the return mail to avoid confusion therebetween.

Patent Document 3 above has the following problems. As this envelope also uses the same face of the envelope body (21) for displaying the addressees of the outgoing mail and the return mail, it is necessary to provide a transparent window (4) on the envelope body (21). As the spaces for displaying the addressee of the return mail and for affixing a stamp therefor need to be provided on the return-mail flap (23), the flap (23) should be considerably large in size. Further, it will be difficult to secure enough spaces for writing the information about the sender of the outgoing mail and about the sender of the return mail and it will also be difficult to avoid the confusion therebetween.

Patent Document 4 above has a problem that it is necessary to provide an additional sheet as a sealing lid (6) for the outgoing mail. It is also necessary to glue the sheet in a smoothly removable manner.

Patent Document 5 above has the following problems. While the envelope makes it possible to use the sealing tongue for sealing twice by providing the adhesive strip (4) for the outgoing mail and the adhesive strip (6) for the return mail, the tongue needs to be considerably large in area because the two adhesive strips have to be arranged in parallel. Further, as the outgoing address and the return address have to be displayed on the same face (1) of the envelope, it is necessary to make the face (1) of the envelope with a transparent sheet. Furthermore, it will be difficult to secure enough spaces for writing the information about the sender of the outgoing mail and about the sender of the return mail and it will also be difficult to avoid the confusion therebetween.

While Patent Document 6 above provides the round trip envelope configured to display the outgoing address on the front face of the envelope and the return address on the back face of the envelope, it has the following problems. On the face for the return mail, two strips of an adhesive strip (2) for outgoing mail and an adhesive strip (5) for return mail are provided in parallel in the position above the area for displaying the return address. This makes it necessary to secure a considerably large area for the sealing tongue of the envelope. Moreover, at the time of sending the outgoing mail, the spaces for writing the return address and for affixing a stamp on the return-mail side are completely exposed. If the name and address are written and a stamp is affixed in advance for the return mail, it will be extremely difficult to distinguish between the outgoing mail and the return mail, in which case a wrong side may be postmarked erroneously.

In view of the foregoing, an object of the present invention is to solve the problems of the conventional techniques as described above by providing a round trip envelope which allows a front face and a back face of the envelope to be used for writing the outgoing and return addresses with sufficient room, which enables sealing for both of outgoing mail and return mail without the need to considerably enlarge a sealing flap, which avoids confusion between the outgoing and return addresses written on the envelope, and which can prevent erroneous postmarking of a stamp or the like.

Means for Solving the Problems

To accomplish the above object, a round trip envelope according to the present invention has a first feature that it is a round trip envelope having an opening for inserting materials to be mailed into an envelope body and having a sealing flap folded at a position of the opening so as to seal the envelope body, wherein the envelope body has a front face on which at least an outgoing stamp affixing area and an outgoing address writing area are provided, and a back face on which at least a return stamp affixing area and a return address writing area are provided, and an adhesive area for adhering the sealing flap to the back face of the envelope body is provided in one or both of a blank area on the back face in a vicinity of the opening and a blank area on the sealing flap corresponding to the blank area on the back face, and a distal end portion of the sealing flap extending beyond the adhesive area constitutes a return-mail sealing flap which is re-folded from the back face onto the front face when sending return mail.

Further, the round trip envelope according to the present invention has, in addition to the above-described first feature, a second feature that the sealing flap is provided as an extension of the front face of the envelope body to extend beyond the position of the opening, and the extension length of the sealing flap is set such that, when the sealing flap is folded onto the back face, the sealing flap can cover at least a part of the return stamp affixing area.

Further, the round trip envelope according to the present invention has, in addition to the above-described first or second feature, a third feature that a fold line of the sealing flap is provided at or above the position of the opening of the envelope body, and a cutting line indication indicating a position along which the envelope body sealed with the adhesive area should be opened is provided in a vicinity of the fold line on one or both sides thereof.

Further, the round trip envelope according to the present invention has, in addition to any of the above-described first through third features, a fourth feature that the outgoing stamp affixing area and the return stamp affixing area are outlined by stamp affixing boxes and are arranged in upper shoulder portions, near the opening, of the front face and the back face, respectively, of the envelope body.

Further, the round trip envelope according to the present invention has, in addition to any of the above-described first through fourth features, a fifth feature that postal code columns are provided in upper portions, near the opening, of the front face and the back face of the envelope body, at one sides of the stamp affixing areas.

Further, the round trip envelope according to the present invention has, in addition to any of the above-described first through fifth features, a sixth feature that the stamp affixing area includes a postage indicia indication area in which a postage indicium fulfilling a postage requirement equivalent to a stamp is indicated.

Further, the round trip envelope according to the present invention has, in addition to any of the above-described first through sixth features, a seventh feature that a distal end portion of the sealing flap extending beyond the adhesive area has a back face at least a part of which is temporarily adhered to the back face of the envelope body in such a way as to be releasable and not re-adherable.

Effects of the Invention

According to the round trip envelope recited in claim 1, at least the outgoing stamp affixing area and the outgoing address writing area are provided on the front face of the envelope body, and at least the return stamp affixing area and the return address writing area are provided on the back face thereof. For using the envelope for outgoing mail, a user may affix a stamp in the stamp affixing area on the front face and write the name and address of the recipient in the address writing area on the front face. For using the envelope for return mail, a user may affix a stamp in the stamp affixing area on the back face and write the name and address of the recipient in the address writing area on the back face. As such, the stamps and the names and addresses for the outgoing mail and the return mail can be placed separately on the front face and the back face, respectively, of the envelope body, with sufficient room, in an easily understandable manner, and without creating confusion.

As the outgoing address writing area and the return address writing area are provided on the front face and the back face, respectively, of the envelope body, at the time of sending outgoing mail, the sender can write or print the name and address on the back face in advance, in addition to the name and address on the front face.

Further, the adhesive area for adhering the sealing flap to the back face of the envelope body is provided in one or both of the blank area on the back face in the vicinity of the opening and the blank area on the sealing flap corresponding to the blank area on the back face, and the distal end portion of the sealing flap extending beyond the adhesive area is configured to serve as the return-mail sealing flap which is re-folded from the back face onto the front face when sending the return mail.

As the adhesive area is arranged in the blank area in the vicinity of the opening, the adhesive area can be restricted to the area near the opening. This can minimize the increase in area of the sealing flap because of the distance from the opening to the adhesive area. In particular, as the adhesive area to which an adhesive is applied is arranged in the blank area in the vicinity of the opening, the distal end portion of the sealing flap extending beyond the adhesive area becomes long and wide. As this portion is used as the return-mail sealing flap, the sealing for the return mail can be done with sufficient dimensional margin.

According to the round trip envelope recited in claim 2, in addition to the functions and effects obtained by the configuration recited in claim 1 above, the sealing flap is provided as an extension of the front face of the envelope body to extend beyond the position of the opening, and the extension length of the sealing flap is set such that, when the sealing flap is folded onto the back face, the sealing flap can cover at least a part of the return stamp affixing area.

When the envelope is used for outgoing mail, only the stamp affixed to the front face of the envelope can be postmarked at the post office or the like. Even if a stamp is affixed in advance to the back face of the envelope, it is ensured that at least a part of the stamp is covered. This can surely avoid the confusion or inconvenience that the stamp on the back face is erroneously postmarked when the envelope is sent as outgoing mail.

Further, according to the round trip envelope recited in claim 3, in addition to the functions and effects obtained by the configuration recited in claim 1 above, the fold line of the sealing flap is provided at or above the position of the opening of the envelope body, and the cutting line indication indicating the position along which the envelope body sealed with the adhesive area should be opened is provided in the vicinity of the fold line on one or both sides thereof.

The outgoing mail can be opened as the envelope is cut along the cutting line. Even after the envelope is cut open along the cutting line, on the back face of the envelope body, a part of the sealing flap remains adhered to the part of the adhesive area remaining over a certain range below the cutting line. Further, the distal end portion of the sealing flap is left free in a non-adhered state, making it readily possible to use this portion as the return-mail sealing flap.

Furthermore, according to the round trip envelope recited in claim 4, in addition to the functions and effects obtained by the configuration recited in any of claims 1 to 3 above, the outgoing stamp affixing area and the return stamp affixing area are outlined by stamp affixing boxes and are arranged in the upper shoulder portions, near the opening, of the front face and the back face, respectively, of the envelope body.

When sending the outgoing mail, the sender can affix an outgoing stamp in the stamp affixing box on the front face of the envelope body, and additionally affix a return stamp in the stamp affixing box on the back face in advance, on behalf of the recipient who is to send the return mail. The return stamp affixing box allows the user to readily find where to affix the return stamp. As the return stamp is affixed in the upper portion, near the opening, on the back face of the envelope body, at least a part of the return stamp affixed in advance can readily and surely be covered and hidden by the sealing flap that is folded back onto the back face when sending the outgoing mail. This prevents the return stamp affixed to the back face from being erroneously postmarked when the envelope is sent as the outgoing mail. When the envelope is used for return mail, the return-mail sealing flap placed on the back face of the envelope body is re-folded onto the front face, so that it can surely cover and hide the outgoing stamp affixed in the upper shoulder portion of the front face near the opening.

Furthermore, according to the round trip envelope recited in claim 5, in addition to the functions and effects obtained by the configuration recited in any of claims 1 to 4 above, the postal code columns are provided in the upper portions, near the opening, of the front face and the back face of the envelope body, at one sides of the stamp affixing areas.

The sender of outgoing mail can fill in, not only the outgoing postal code column, but also the return postal code column in advance, for the convenience of the sender of the return mail. Further, when the envelope is sent as outgoing mail, the sealing flap can cover the return postal code in addition to the return stamp affixed in advance on the back face. This can more reliably prevent the outgoing envelope from being erroneously postmarked or misdelivered.

Furthermore, according to the round trip envelope recited in claim 6, in addition to the functions and effects obtained by the configuration recited in any of claims 1 to 5 above, a postage indicia indication area in which a postage indicium fulfilling the postage requirement equivalent to a stamp is indicated is used instead of the stamp affixing area.

Accordingly, it is also possible to provide a round trip envelope which uses a postage indicium, such as "postpaid mail" or "postage deferred payment mail", fulfilling the postage requirement equivalent to affixing a stamp.

Furthermore, according to the round trip envelope recited in claim 7, in addition to the functions and effects obtained by the configuration recited in any of claims 1 to 6 above, the distal end portion of the sealing flap extending beyond the adhesive area has its back face at least a part of which is temporarily adhered to the back face of the envelope body in such a way as to be releasable and not re-adherable.

At the time when the sealing flap is adhered to the envelope body via the adhesive area for sending outgoing mail, the above configuration can prevent the distal end portion of the sealing flap extending beyond the adhesive area, i.e. the portion constituting the return-mail sealing flap, from being freed from the envelope body and becoming a hindrance or crimped. For sending return mail, the temporarily adhered portion can just be released, so that the portion can be used as the return-mail sealing flap for sealing the return envelope; undesirable re-adhesion will not take place.

MODES FOR CARRYING OUT THE INVENTION

Figure 1:
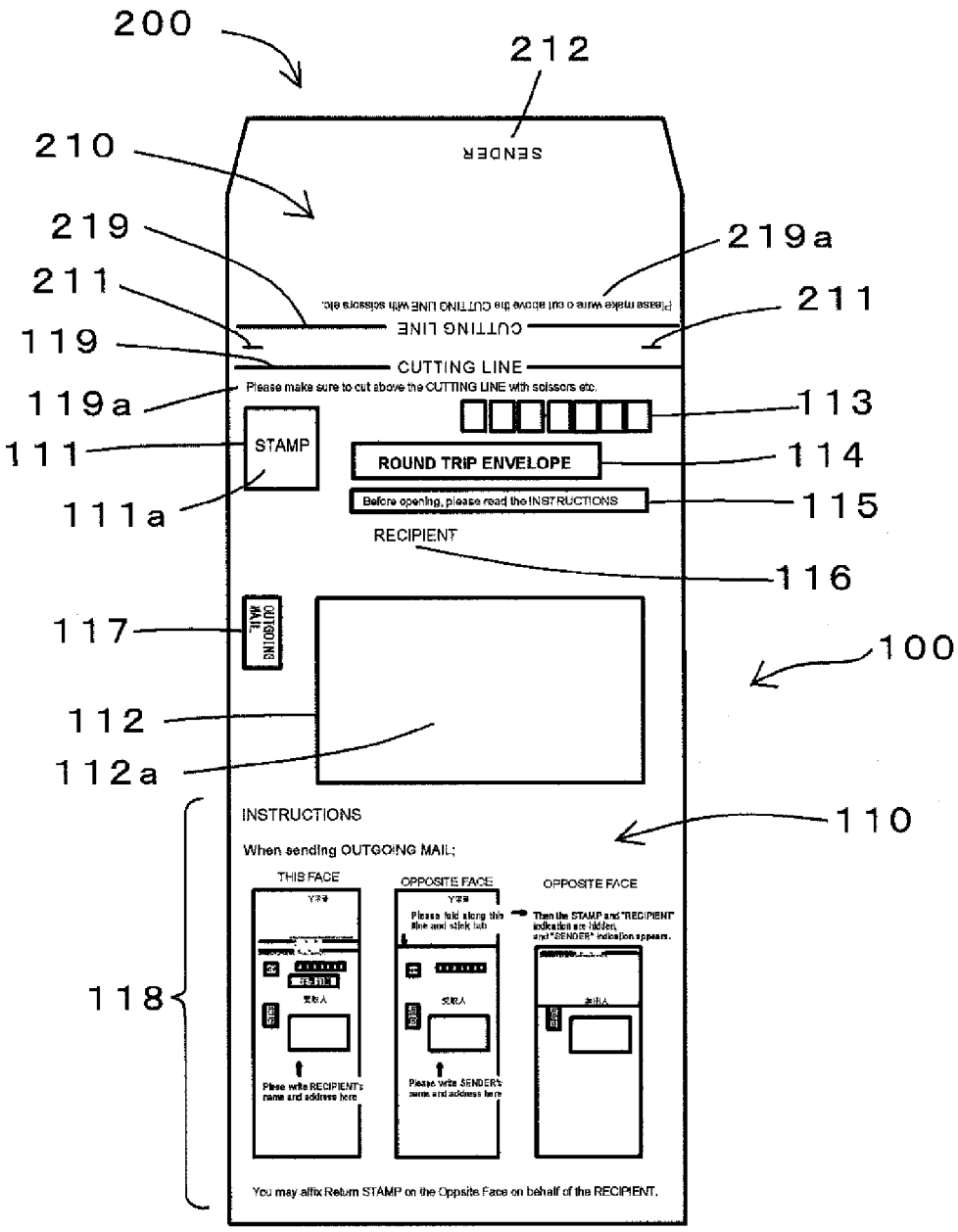
FIG. 1 is a diagram showing a front face of a round trip envelope according to an embodiment of the present invention.
Figure 2:
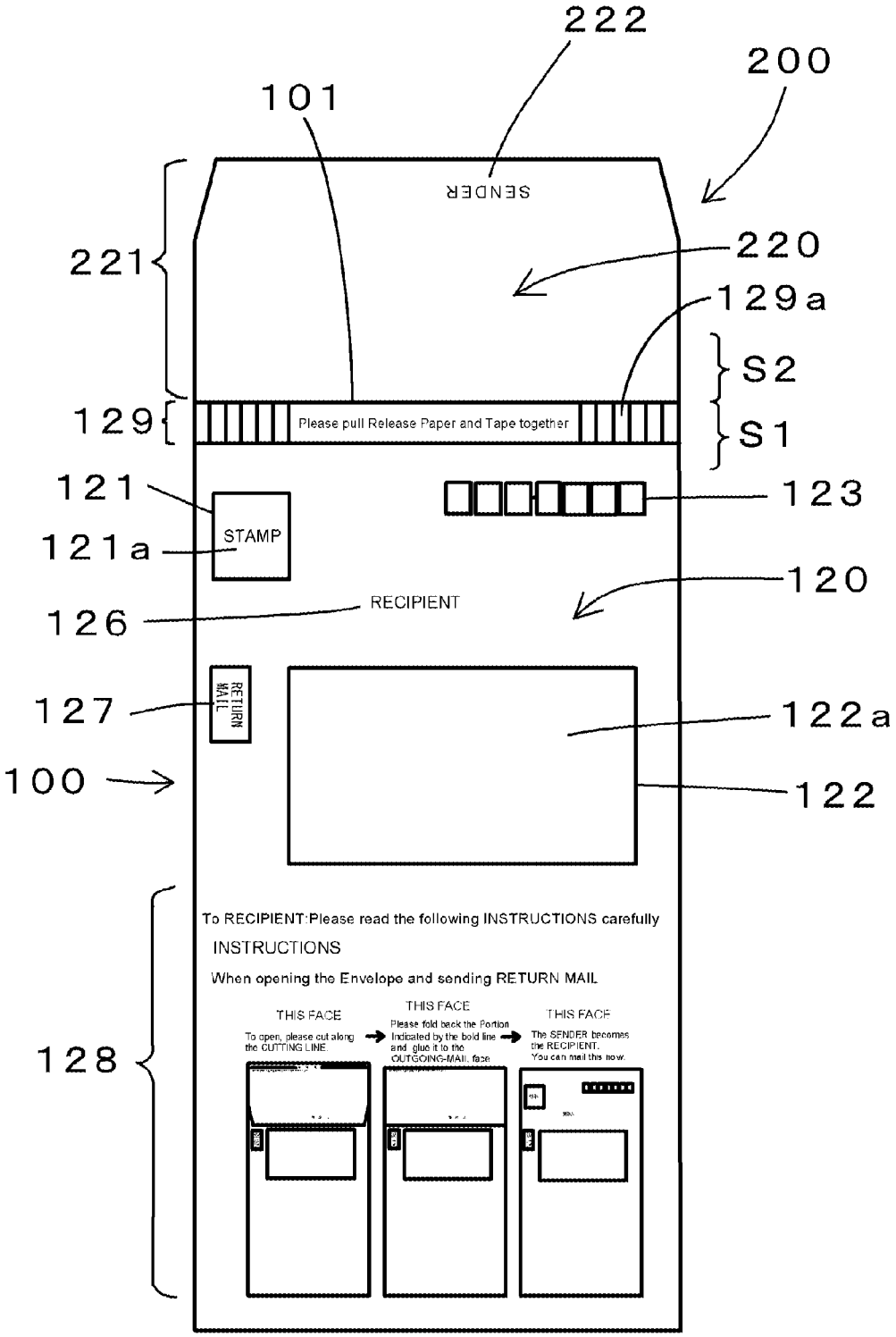
FIG. 2 is a diagram showing a back face of the round trip envelope according to the present embodiment.

Referring first to FIGS. 1 and 2, an overall configuration of the round trip envelope according to an embodiment of the present invention will be described.

The round trip envelope is composed of an envelope body 100 and a sealing flap 200. In the present embodiment, the round trip envelope has a vertically long shape.

The envelope body 100 has a front face 110, shown in FIG. 1, and a back face 120, shown in FIG. 2. Similarly, the sealing flap 200 has a front face 210, shown in FIG. 1, and a back face 220, shown in FIG. 2.

The envelope body 100 is provided with an opening 101 for inserting materials to be mailed.

The sealing flap 200 is provided as an extension of the front face 110 of the envelope body 100, to extend beyond the position of the opening 101.

On the front face 110 of the envelope body 100, an outgoing stamp affixing area 111*a* is provided. This outgoing stamp affixing area 111*a* is arranged, near the opening 101, at the upper left shoulder of the front face 110.

In practice, the outgoing stamp affixing area 111*a* is outlined by an outgoing stamp affixing box 111. Outlining the area can clearly show the position where the outgoing stamp should be affixed.

An outgoing address writing area 112*a* is also provided on the front face 110 of the envelope body 100. In this outgoing address writing area 112*a*, the name and address of the recipient of the outgoing mail are written. This area is arranged at the position slightly upper than the central portion of the front face 110.

In practice, the outgoing address writing area 112*a* is also outlined by an outgoing address writing box 112. Outlining the area can clearly show the position where the name and address of the recipient of the outgoing mail should be written.

In the upper portion of the front face 110, near the opening 101 of the envelope body 100, an outgoing postal code column 113 is provided at a side, to the right shoulder, of the outgoing stamp affixing area 111*a* (return stamp affixing box 111). The outgoing postal code column 113 is positioned approximately at the same level as the upper side of the outgoing stamp affixing box 111.

Further, a round trip envelope indication 114, indicating that this is the round trip envelope, is arranged on the front face 110 of the envelope body 100, next to the outgoing stamp affixing box 111 and beneath the outgoing postal code column 113, and approximately at the center in the lateral direction of the envelope body 100.

An opening precaution 115 is arranged beneath the round trip envelope indication 114, and a recipient indication 116 is arranged beneath the precaution 115.

The recipient indication 116 is positioned above the outgoing address writing box 112, making it clear that the name and address written beneath the recipient indication 116 are the name and address of the recipient.

On the front face 110 of the envelope body 100, an outgoing mail indication 117, indicating that this front face 110 is the outgoing-mail side, is provided beneath the outgoing stamp affixing box 111 arranged in the upper left shoulder portion, and to the left of the outgoing address writing box 112.

Further, instructions 118 for the use of this envelope are arranged in the lower half portion of the front face 110 of the envelope body 100.

On the front face 110, further above the outgoing stamp affixing box 111 and outgoing postal code column 113, a cutting line indication 119 with a horizontal line and the characters CUTTING LINE is arranged. A cutting line precaution 119*a* is arranged immediately beneath the cutting line indication 119.

The cutting line indication 119 is positioned in close proximity to and immediately beneath a fold line indication 211 along which the sealing flap 200 is folded.

On the front face 210 of the sealing flap 200, a sender indication 212 with inverted characters is arranged near its upper end.

Further, on the front face 210 of the sealing flap 200, a cutting line indication 219 with a horizontal line and the inverted characters CUTTING LINE is arranged in close proximity to and immediately above the fold line indication 211. A cutting line precaution 219*a* with inverted characters is arranged immediately above the cutting line indication 219.

The cutting line indication 219 on the sealing flap 200 and the cutting line indication 119 on the envelope body 100 correspond to each other and they are arranged above and beneath the fold line, indicated by the fold line indication 211, at equal short distances therefrom. More specifically, a pair of cutting line indications 219 and 119 are arranged in the vicinity of the fold line indication 211, indicating both the folding position and opening position of the sealing flap 200, on the respective sides of the fold line indication 211 at equal distances therefrom.

The cutting line precaution 219*a* on the sealing flap 200 and the cutting line precaution 119*a* on the envelope body 100 correspond to each other.

The inverted characters of the sender indication 212, the cutting line indication 219, and the cutting line precaution 219*a* appear in an upright orientation when the sealing flap 200 is folded along the fold line indicated by the fold line indication 211 onto the back face 120 of the envelope body 100.

The back face 120 of the envelope body 100 and the back face 220 of the sealing flap 200 will now be described with reference to FIG. 2.

On the back face 120 of the envelope body 100, a return stamp affixing area 121*a* is provided. This return stamp affixing area 121*a* is arranged, near the opening 101, at the upper left shoulder of the back face 120.

In practice, the return stamp affixing area 121*a* is outlined by a return stamp affixing box 121. Outlining the area can clearly show the position where the return stamp should be affixed.

A return address writing area 122*a* is also provided on the back face 120 of the envelope body 100. In this return address writing area 122*a*, the name and address of the recipient of the return mail are written. This area is arranged at the position slightly upper than the central portion of the back face 120.

In practice, the return address writing area 122*a* is also outlined by a return address writing box 122. Outlining the area can clearly show the position where the name and address of the recipient of the return mail should be written.

In the upper portion of the back face 120, near the opening 101 of the envelope body 100, a return postal code column 123 is provided at a side, to the right shoulder, of the return stamp affixing area 121*a* (return stamp affixing box 121). The return postal code column 123 is positioned approximately at the same level as the upper side of the return stamp affixing box 121.

The recipient indication 126 on the back face 120 of the envelope body 100 is positioned above the return address writing box 122, making it clear that the name and address written in the area are those of the recipient.

On the back face 120 of the envelope body 100, a return mail indication 127, indicating that this back face 120 is the return-mail side, is provided beneath the return stamp affixing box 121 arranged in the upper left shoulder portion, and to the left of the return address writing box 122.

Instructions 128 for the use of this envelope are arranged in the lower half portion of the back face 120 of the envelope body 100.

It should be noted that the arrangement positions of the area 121*a*, the box 121, and the column 123 on the back face 120 of the envelope body 100 are slightly lower than the arrangement positions of the area 111*a*, the box 111, and the column 113, respectively, on the front face 110. Their difference in level approximately corresponds to the distance from the opening 101 to the cutting line indication 119 (219).

In the present embodiment, an adhesive area 129 is provided on the back face 120 of the envelope body 100, in an area immediately beneath the opening 101.

This adhesive area 129 is provided in the state where it is covered with release paper 129*a*, for example, as shown in FIG. 2. The release paper 129*a* is peeled off when sealing the envelope for outgoing mail.

The adhesive area 129 is arranged in a blank area S1 on the back face 120 in the vicinity of the opening 101.

The adhesive area 129 may of course be arranged in a blank area S2 on the sealing flap 200 corresponding to the blank area S1. It is also possible to provide adhesive areas on both of the blank areas S1 and S2.

The blank area S1 on the back face 120 extends from the opening 101 down to the position immediately above the areas for showing the information necessary for return mail, such as the return stamp affixing box 121, the return postal code column 123, etc. The adhesive area 129 in a strip shape is formed on a part of this area S1. In the present embodiment, the area extending from the opening 101 to the middle position of the blank area S1 constitutes the adhesive area 129. Providing the adhesive area 129 in the blank area S1 in this manner is advantageous in that, even when the envelope is sealed with the sealing flap 200, the display areas necessary for the return mail, including the return stamp affixing box 121 and the return postal code column 123, on the back face 120 are prevented from being spoiled, and that the distal end portion 221 of the sealing flap 200 extending beyond the adhesive area 129 can cover and hide, in a non-adhered state, the stamp affixed in the return stamp affixing box 121 (return stamp affixing area 121*a*) and the postal code filled in the return postal code column 123. Hiding them in this manner can reliably prevent the return-mail side from being erroneously postmarked or the envelope from being misdelivered to the address indicated by the postal code shown on the return-mail side when the envelope is sent as the outgoing mail.

The dimensional relationship between the adhesive area 129 and the cutting line indications 119, 219 is configured such that the distance from the opening 101 to the lower end of the adhesive area 129 is greater than the distance from the opening 101 to each cutting line indication 119, 219. With this dimensional relationship, when the envelope is cut open at the position indicated by the cutting line indications 119, 219, a part of the adhesive area 129 remains uncut, allowing a part of the sealing flap 200 to be kept stuck to the remaining part of the adhesive area 129.

Instead of providing the adhesive area 129 on the back face 120 of the envelope body 100, an adhesive area may be provided in the blank area S2 on the back face 220 of the sealing flap 200 corresponding to the blank area S1. The adhesive areas may be provided on both of the blank areas S1 and S2.

On the back face 220 of the sealing flap 200, a sender indication 222 with inverted characters is arranged near its upper end.

The round trip envelope of the present invention will further be described below, with reference to FIGS. 3 to 7 as well, by explaining how the envelope is used for outgoing mail and return mail.

Figure 3:
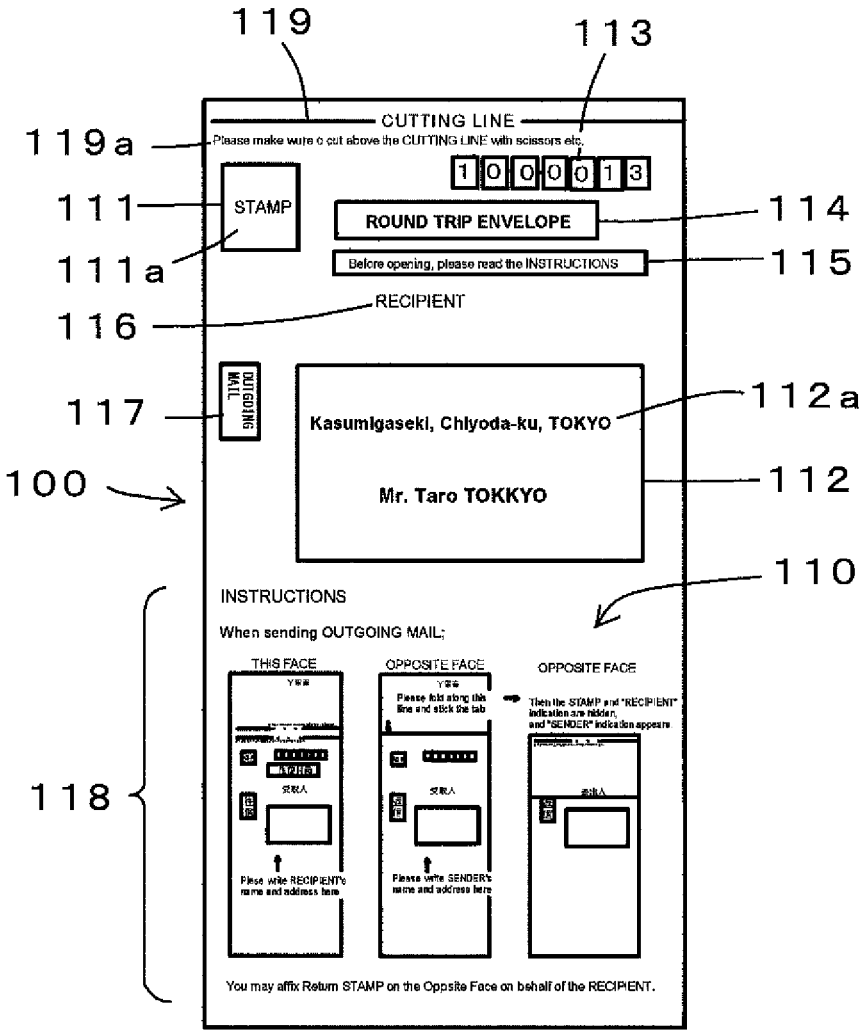
FIG. 3 is a diagram showing the front face of the round trip envelope according to the present embodiment in the state where the envelope has been sealed for outgoing mail.

First, as shown in FIG. 3, a sender of outgoing mail uses the front face 110 of the round trip envelope shown in FIG. 1 to write the name and address of the recipient (Mr. Taro Patent, . . . , Tokyo) in the outgoing address writing area 112*a* within the outgoing address writing box 112, fill in the outgoing postal code column 113 with the postal code of the recipient (100-0013), and affix a stamp in the outgoing stamp affixing area 111*a* within the outgoing stamp affixing box 111. This concludes the work on the front face 110.

The sender of the outgoing mail then folds the sealing flap 200, along the fold line indication 211 at the opening 101, onto the back face 120, and removes the release paper 129*a* from the adhesive area 129 to adhere the sealing flap 200 to the back face. The envelope is now ready for mailing.

Figure 4:
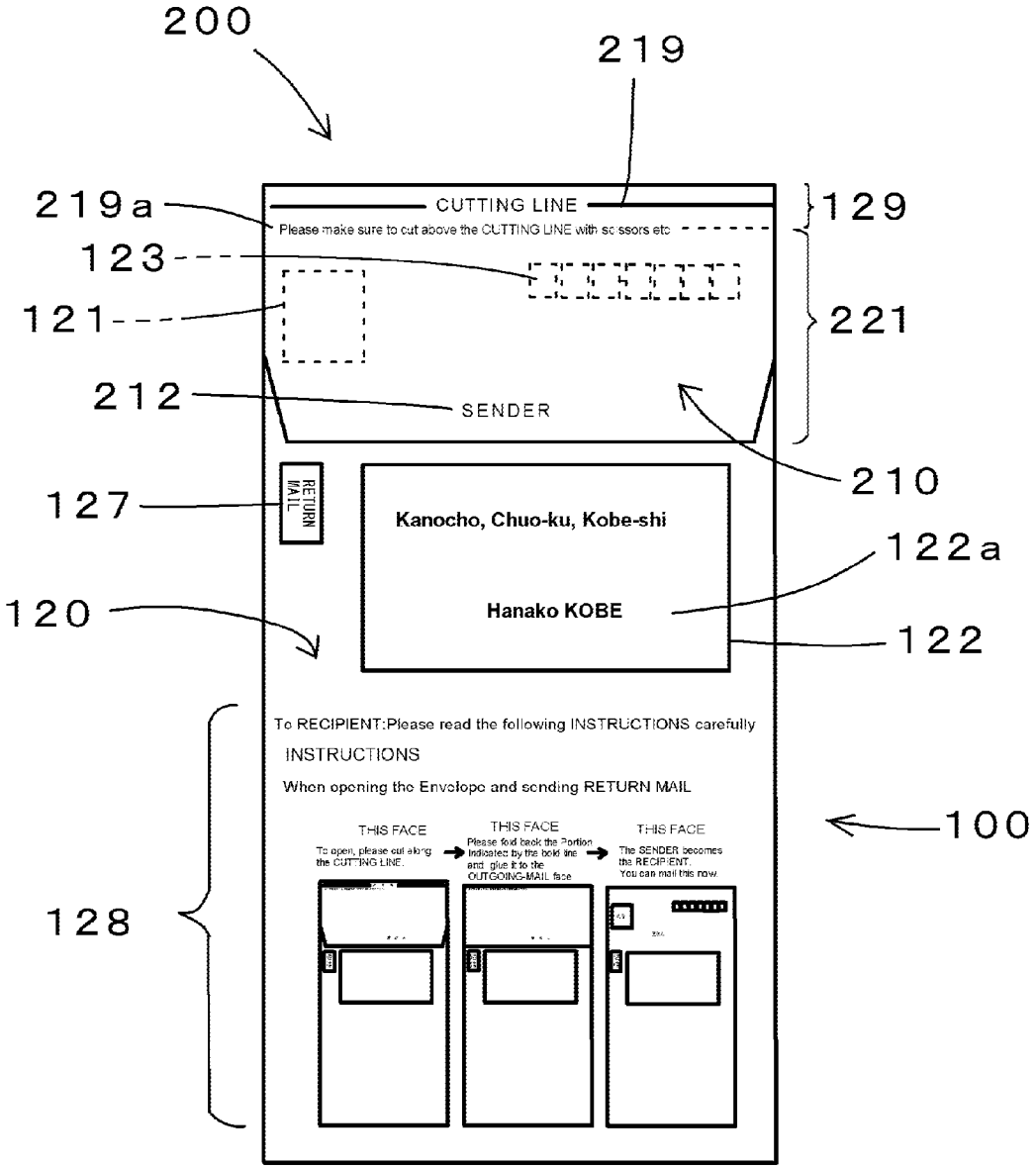
FIG. 4 is a diagram showing the back face of the round trip envelope according to the present embodiment in the state where the envelope has been sealed for outgoing mail.

Referring to FIGS. 2 and 4, before sealing with the sealing flap 200, the sender may affix a stamp in the return stamp affixing area 121*a* within the return stamp affixing box 121 on the back face 120, on behalf of the recipient. This can save the postage expense and burden of the recipient when he/she sends return mail. Further, the sender can write the name and address of the sender (Hanako Kobe, . . . , Kobe-city) in advance in the return address writing area 122*a* within the return address writing box 122 and also fill in the return postal code column 123 with the postal code of the sender (650-0001).

Even in the case where the sender writes the name and address and postal code and affix a stamp on the back face 120 in advance on behalf of the recipient who becomes a sender of return mail, the sealing flap 200 adhered to the back face 120 via the adhesive area 129 can hide the stamp affixed in the return stamp affixing box 121 and the postal code filled in the return postal code column 123, thereby preventing the return stamp from being erroneously postmarked or the envelope from being misdelivered to the return address written on the back face.

Obviously, on the back face 120 of the round trip envelope when it is originally mailed, there is the return mail indication 127, as shown in FIG. 4. In addition, as the sealing flap 200 is folded and sealed, the recipient indication 126 is covered and hidden, and at the same time, the sender indication 212 on the sealing flap 200 moves to the back face 120 side and is placed immediately above the return address writing box 122 in an upright orientation. Accordingly, it is understood that, for outgoing mail, the back face 120 of the envelope body 100 bears the information about the sender (of the outgoing mail). This can avoid the occurrence of misunderstanding.

Figure 5:
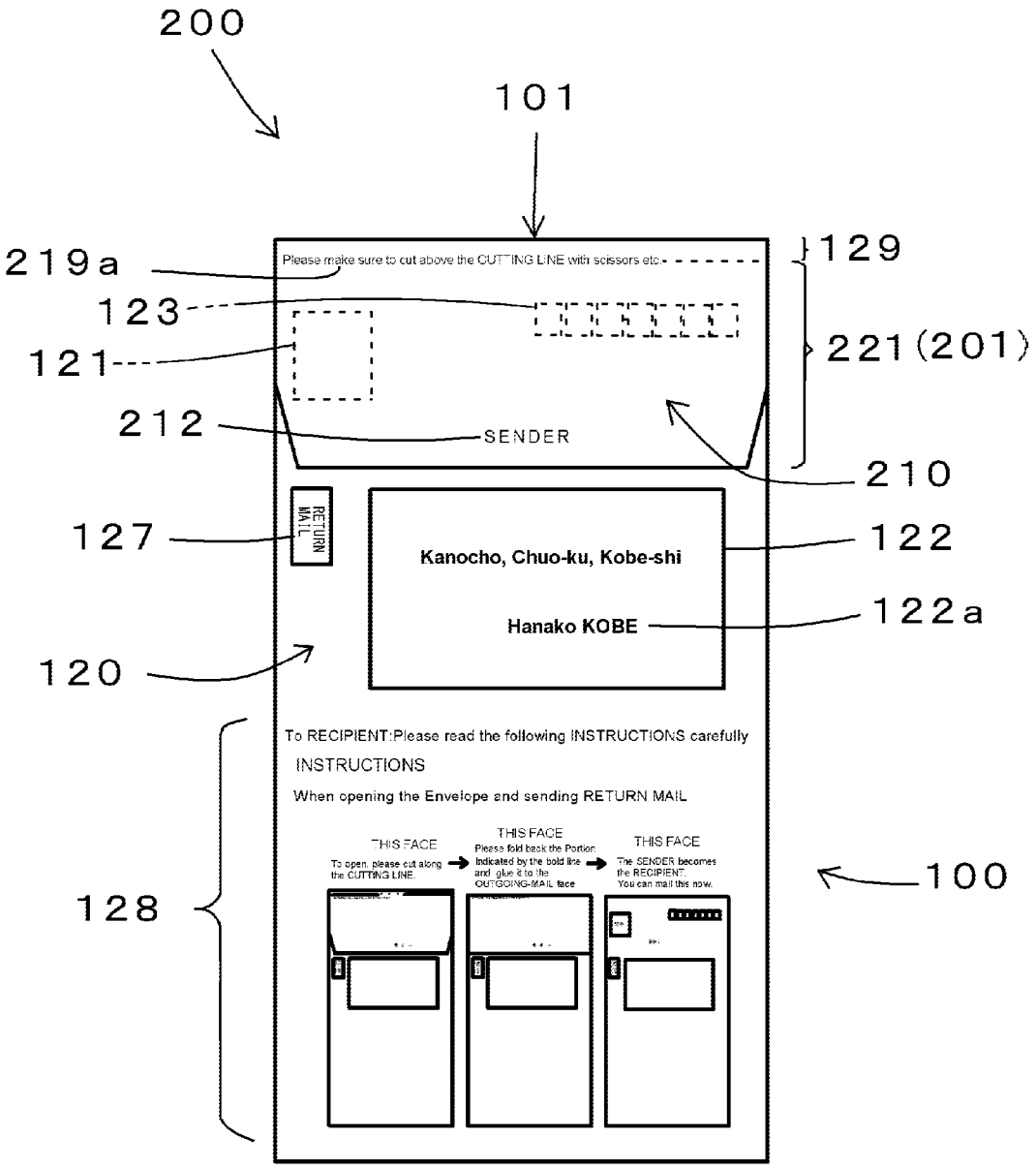
FIG. 5 is a diagram showing the back face of the round trip envelope according to the present embodiment in the state where the outgoing mail has been opened.

Referring to FIGS. 4 and 5, a recipient of the outgoing mail (who is to send the return mail) can easily open the envelope by cutting the envelope in accordance with the cutting line indications 119, 219. At this time, the adhesive area 129 remains over a certain range below the cutting line indicated by the cutting line indications 119, 219, allowing the corresponding portion of the sealing flap 200 to be kept stuck thereto.

More specifically, the sealing flap 200 remains adhered to the back face 120 via the adhesive area 129 left below the cutting line, and the distal end portion 221 of the sealing flap 200 extending beyond the adhered portion remains in a non-adhered state. This non-adhered portion at the distal end of the sealing flap 200 can constitute a sealing flap 201 for return mail.

This return-mail sealing flap 201 is re-folded from the back face 120 onto the front face 110, so that it can be used to seal the envelope when it is used as a return envelope.

The length of the return-mail sealing flap 201 is preferably determined such that, when it is re-folded onto the front face 110 of the envelope body 100, it can cover and hide the stamp affixed in the outgoing stamp affixing box 111 (outgoing stamp affixing area 111*a*), the outgoing postal code column 113, and the recipient indication 116. However, it should be noted that the front face 110 and the back face 120 are configured to have the relationship in terms of display which is adjusted in advance such that, when the length (dimension) of the sealing flap 200 is set to the length (dimension) sufficient to hide the return stamp affixing box 121, the return postal code column 123, and the recipient indication 126 on the back face 120 at the time of sending outgoing mail, then the dimension of the return-mail sealing flap 201 will become an appropriate dimension for hiding the above-described areas on the front face at the time of sending return mail.

Figure 6:
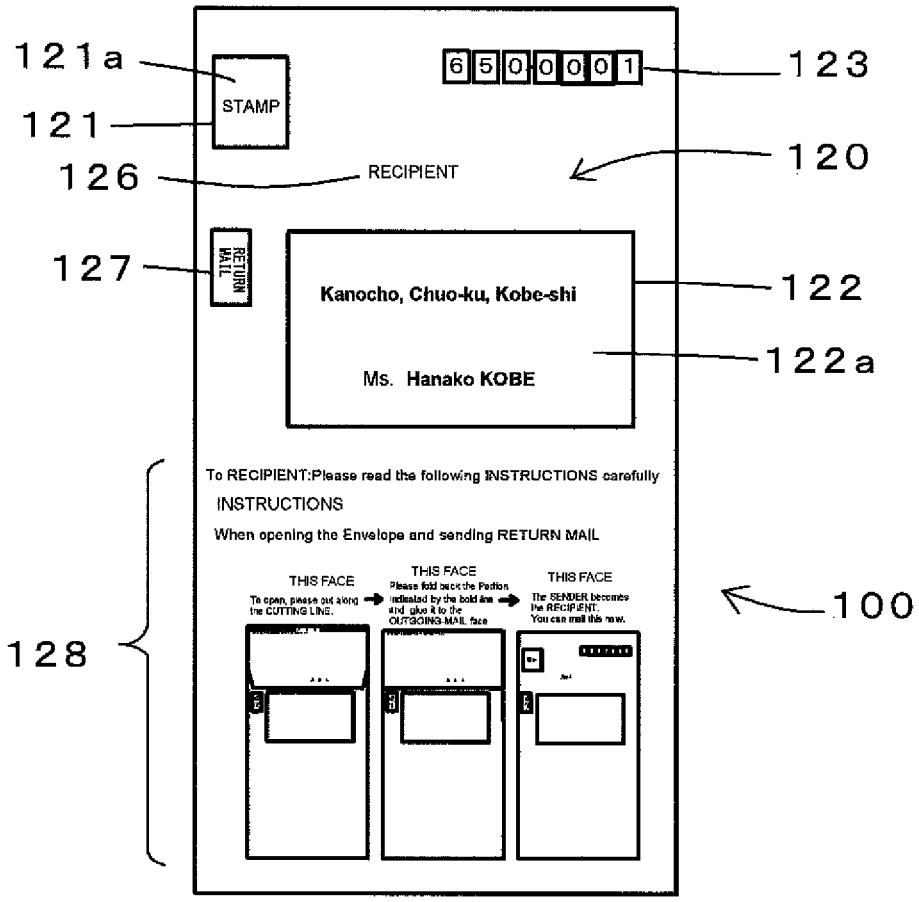
FIG. 6 is a diagram showing the back face of the round trip envelope according to the present embodiment in the state where the envelope has been sealed for return mail.
Figure 7:
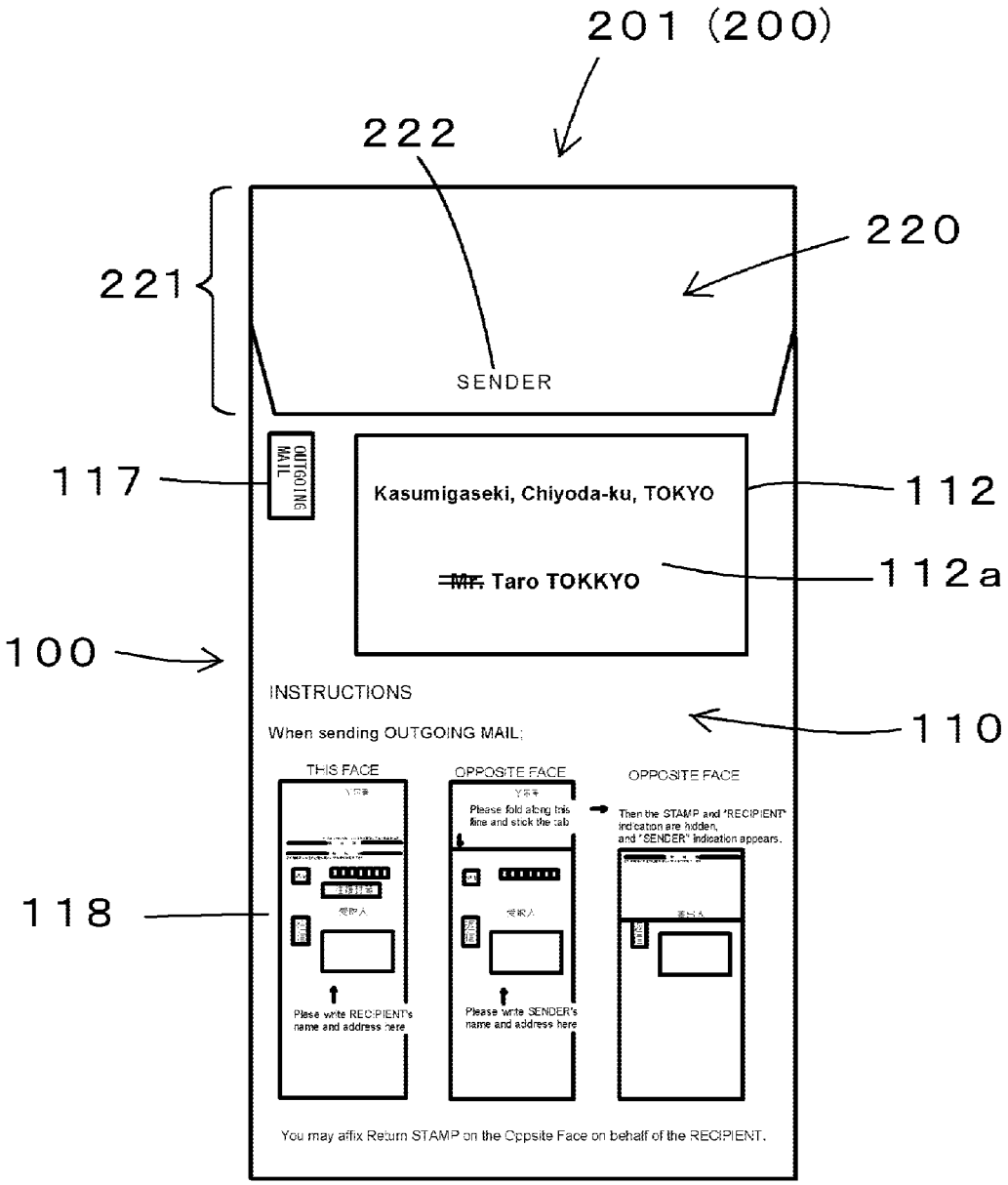
FIG. 7 is a diagram showing the front face of the round trip envelope according to the present embodiment in the state where the envelope has been sealed for return mail.

Referring to FIGS. 5 to 7, in the case where the recipient of the outgoing mail becomes a sender of the return mail, he/she folds the return-mail sealing flap 201 on the back face 120 onto the front face 110, to expose the return stamp affixing box 121 (return stamp affixing area 121*a*), the return postal code column 123, and the recipient indication 126 on the back face 120.

Then, the sender of the return mail affixes a stamp to the position indicated by the return stamp affixing box 121 (return stamp affixing area 121*a*) and fills in the return postal code column 123 with the postal code on the back face 120. When the sender of the outgoing mail has already affixed the stamp and written the postal code, the sender of the return mail can save the cost and burden required therefor.

It should be noted that in the return address writing area 122*a* within the return address writing box 122, the sender of the outgoing mail has usually written his/her own name and address as the original sender, and therefore, the sender of the return mail is usually unnecessary to fill in the area. However, he/she may have to add a title of respect such as Mr. or Ms. to the name, or correct or delete the information provided in the area.

The sender of the return mail inserts materials to be returned into the envelope body 100, glues the re-folded return-mail sealing flap 201 to the front face, whereby the return-mail envelope becomes ready for mailing.

At this time, on the front face 110, the postmarked stamp in the outgoing stamp affixing box 111 (outgoing stamp affixing area 111*a*), the postal code for outgoing mail in the outgoing postal code column 113, the round trip envelope indication 114, the opening precaution 115, and the recipient indication 116 are covered and hidden by the return-mail sealing flap 201. Further, the sender indication 222 on the back face 220 of the sealing flap 200 is positioned immediately above the outgoing address writing box 112, in an upright orientation. Accordingly, it is understood that, for return mail, the front face 110 bears the information about the sender (of the return mail). This can avoid the occurrence of misunderstanding.

In the above description, the outgoing stamp affixing area 111*a* within the outgoing stamp affixing box 111 may be replaced with a postage indicia indication area in which a postage indicium fulfilling the postage requirement equivalent to a stamp is indicated. Similarly, the return stamp affixing area 121*a* within the return stamp affixing box 121 may be replaced with a postage indicia indication area in which a postage indicium fulfilling the postage requirement equivalent to a stamp is indicated.

Further, for the outgoing mail, the sealing flap 200 is adhered to the envelope body 100 only via the adhesive area 129. The distal end portion 221 of the sealing flap 200 extending beyond the adhesive area 129 is free from the envelope body 100, which is not so desirable because the loose portion may become a hindrance or crimped.

It is preferable that the distal end portion of the sealing flap 200 is secured even in the outgoing mail. Thus, in the present invention, it may be configured such that the distal end portion of the sealing flap 200 is temporarily adhered to the back face 120 of the envelope body 100 when the envelope is sent as outgoing mail.

The term "temporarily adhered" means that it is adhered in such a way as to be releasable and not re-adherable.

For implementing such temporary adhesion, a temporary adhesive, which is releasable and not re-adherable as described above, may be applied in advance to one or both of: at least a part of the back face 220 of the sealing flap 200 at the distal end portion extending beyond the adhesive area; and at least a part of the portion of the back face 120 of the envelope body 100 corresponding to the distal end portion of the sealing flap 200, and the temporary adhesive may be covered with release paper. This configuration enables the temporary adhesion when sealing the outgoing mail.

It should be noted that the release paper for the temporary adhesion may be combined with the release paper for the adhesive area 129 for use in sealing the outgoing mail, so that a single sheet of release paper may be provided.

DESCRIPTION OF THE REFERENCE CHARACTERS

100 envelope body
101 opening
111 outgoing stamp affixing box
111*a* outgoing stamp affixing area
112 outgoing address writing box
112*a* outgoing address writing area
113 outgoing postal code column
114 round trip envelope indication
115 opening precaution
116 recipient indication
117 outgoing mail indication
118 instructions
119 cutting line indication
119*a* cutting line precaution
120 back face
121 return stamp affixing box
121*a* return stamp affixing area
122 return address writing box
122*a* return address writing area
123 return postal code column
126 recipient indication
127 return mail indication
128 instructions
129 adhesive area
129*a* release paper
200 sealing flap
201 return-mail sealing flap
210 front face
211 fold line indication
212 sender indication
219 cutting line indication
219*a* cutting line precaution
220 back face
221 distal end portion of the sealing flap
222 sender indication
S1 blank area
S2 blank area

What is claimed is:

1. A round trip envelope having an opening for inserting materials to be mailed into an envelope body and having a sealing flap folded at a position of the opening so as to seal the envelope body, wherein the envelope body has a front face on which at least an outgoing stamp affixing area and an outgoing address writing area are provided, and a back face on which at least a return stamp affixing area and a return address writing area are provided, an adhesive area for adhering the sealing flap to the back face of the envelope body is provided in one or both of a blank area on the back face in a vicinity of the opening and a blank area on the sealing flap corresponding to the blank area on the back face, and a distal end portion of the sealing flap extending beyond the adhesive area constitutes a return-mail sealing flap which is re-folded from the back face onto the front face when sending return mail, and wherein a distal end portion of the sealing flap extending beyond the adhesive area has a back face at least a part of which is temporarily adhered to the back face of the envelope body by a portion of the adhesive area in such a way as to be releasable and not re-adherable.

2. The round trip envelope according to claim 1, wherein the sealing flap is provided as an extension of the front face of the envelope body to extend beyond the position of the opening, and the extension length of the sealing flap is set such that, when the sealing flap is folded onto the back face, the sealing flap can cover at least a part of the return stamp affixing area.

3. The round trip envelope according to claim 2, wherein a fold line of the sealing flap is provided at or above the position of the opening of the envelope body, and a cutting line indication indicating a position along which the envelope body sealed with the adhesive area should be opened is provided in a vicinity of the fold line on one or both sides thereof.

4. The round trip envelope according to claim 2, wherein the outgoing stamp affixing area and the return stamp affixing area are outlined by stamp affixing boxes and are arranged in upper shoulder portions, near the opening, of the front face and the back face, respectively, of the envelope body.

5. The round trip envelope according to claim 2, wherein postal code columns are provided in upper portions, near the opening, of the front face and the back face of the envelope body, at one sides of the stamp affixing areas.

6. The round trip envelope according to claim 2, wherein the stamp affixing area includes a postage indicia indication area in which a postage indicium fulfilling a postage requirement equivalent to a stamp is indicated.

7. The round trip envelope according to claim 1, wherein a fold line of the sealing flap is provided at or above the position of the opening of the envelope body, and a cutting line indication indicating a position along which the envelope body sealed with the adhesive area should be opened is provided in a vicinity of the fold line on one or both sides thereof.

8. The round trip envelope according to claim 7, wherein the outgoing stamp affixing area and the return stamp affixing area are outlined by stamp affixing boxes and are arranged in upper shoulder portions, near the opening, of the front face and the back face, respectively, of the envelope body.

9. The round trip envelope according to claim 7, wherein postal code columns are provided in upper portions, near the opening, of the front face and the back face of the envelope body, at one sides of the stamp affixing areas.

10. The round trip envelope according to claim 7, wherein the stamp affixing area includes a postage indicia indication area in which a postage indicium fulfilling a postage requirement equivalent to a stamp is indicated.

11. The round trip envelope according to claim 1, wherein the outgoing stamp affixing area and the return stamp affixing area are outlined by stamp affixing boxes and are arranged in upper shoulder portions, near the opening, of the front face and the back face, respectively, of the envelope body.

12. The round trip envelope according to claim 11, wherein the stamp affixing area includes a postage indicia indication area in which a postage indicium fulfilling a postage requirement equivalent to a stamp is indicated.

13. The round trip envelope according to claim 1, wherein postal code columns are provided in upper portions, near the opening, of the front face and the back face of the envelope body, at one sides of the stamp affixing areas.

14. The round trip envelope according to claim 13, wherein the stamp affixing area includes a postage indicia indication area in which a postage indicium fulfilling a postage requirement equivalent to a stamp is indicated.

15. The round trip envelope according to claim 1, wherein the stamp affixing area includes a postage indicia indication area in which a postage indicium fulfilling a postage requirement equivalent to a stamp is indicated.

* * * * *